United States Patent [19]

Nelson

[11] Patent Number: 4,527,401

[45] Date of Patent: Jul. 9, 1985

[54] APPARATUS AND METHOD FOR MAKING ICE PARTICLES AND METHOD OF MAKING SAID APPARATUS

[75] Inventor: Kenneth L. Nelson, Albert Lea, Minn.

[73] Assignee: King-Seeley Thermos Co., Prospect Heights, Ill.

[21] Appl. No.: 539,091

[22] Filed: Oct. 5, 1983

[51] Int. Cl.[3] ..... F25C 1/14

[52] U.S. Cl. ..... 62/354

[58] Field of Search ..... 62/354, 71

[56] References Cited

U.S. PATENT DOCUMENTS

| | | | |
|---|---|---|---|
| 2,154,677 | 4/1939 | Hartman | 62/354 X |
| 2,449,730 | 9/1948 | Taylor | 62/354 |
| 3,191,398 | 6/1965 | Rader | 62/354 X |
| 3,488,974 | 1/1970 | Lunde | 62/354 X |
| 3,702,543 | 11/1972 | Lyman | 62/354 |
| 3,803,869 | 4/1974 | Neumann et al. | 62/354 X |
| 4,271,682 | 6/1981 | Seki | 62/354 |

*Primary Examiner*—William E. Tapolcai

*Attorney, Agent, or Firm*—Harness, Dickey & Pierce

[57] ABSTRACT

An ice making apparatus is disclosed which includes a refrigeration system and a new and improved combination evaporator and ice-forming assembly for making flake or chip ice. The combination assembly preferably includes a generally horizontal freezer plate with a freezer surface thereon, which is adapted for receiving make-up water thereon. An evaporator means in close physical proximity with the opposite side of the freezer surface functions to form a thin layer of hard-frozen surface ice on the freezer surface and a rotatable ice breaker disposed closely adjacent the freeze surface fractures the substantially fully frozen ice surface layer from the freezer surface into formed ice particles. Preferably, at least the freezer plate and the evaporator coil are integrally encased and molded into a monolithic freezer member composed of a molded polymeric material, with the freezer surface exposed for forming the ice layer thereon. The ice breaker is also preferably composed of a molded polymeric material. The assembly also includes means for compressing quantities of the formed ice particles in order to compressively remove unfrozen water therefrom.

18 Claims, 10 Drawing Figures

FIG. 4.
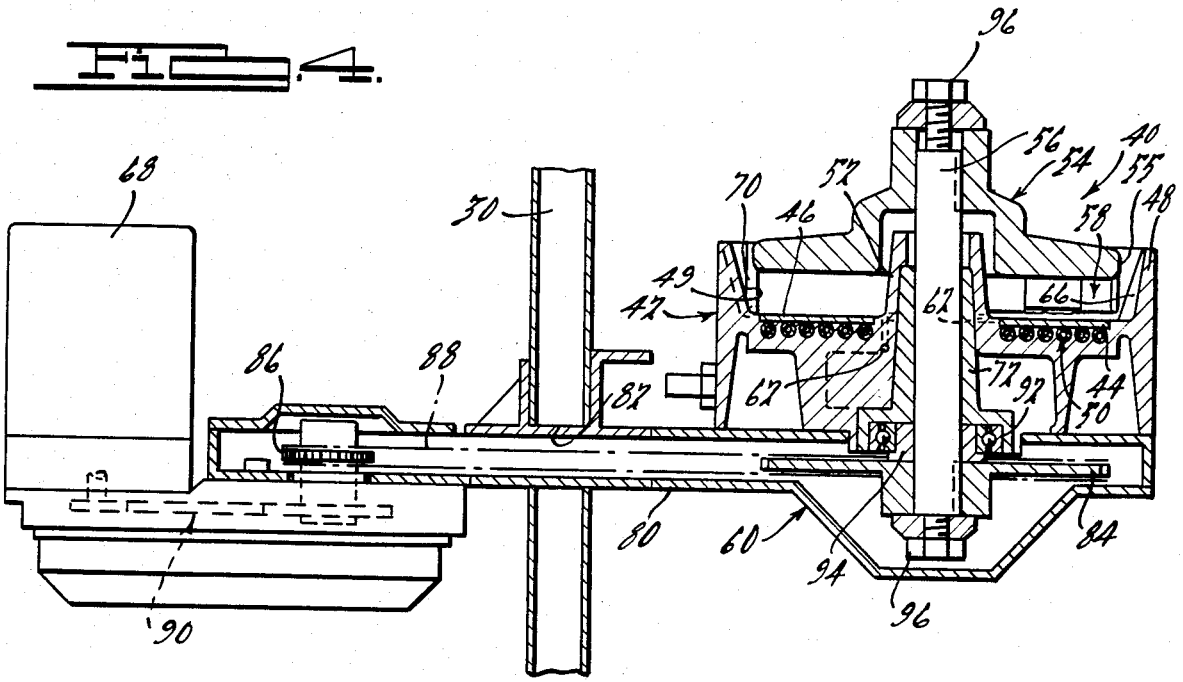
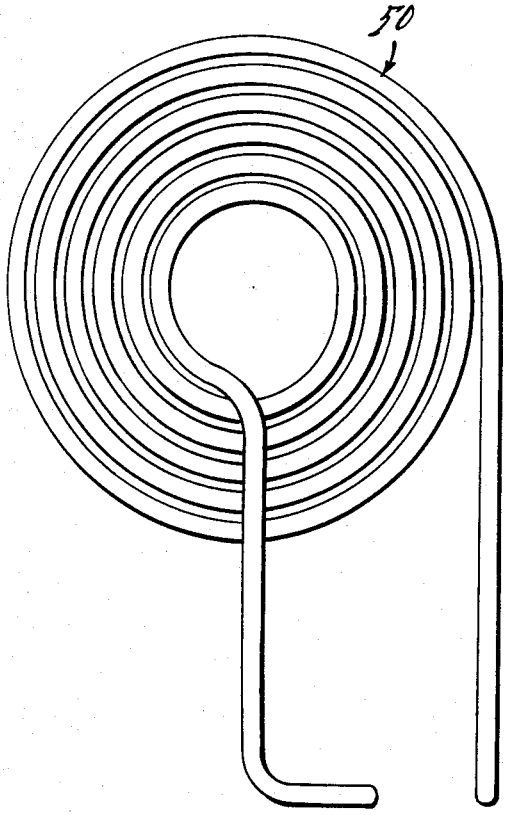
FIG. 5.
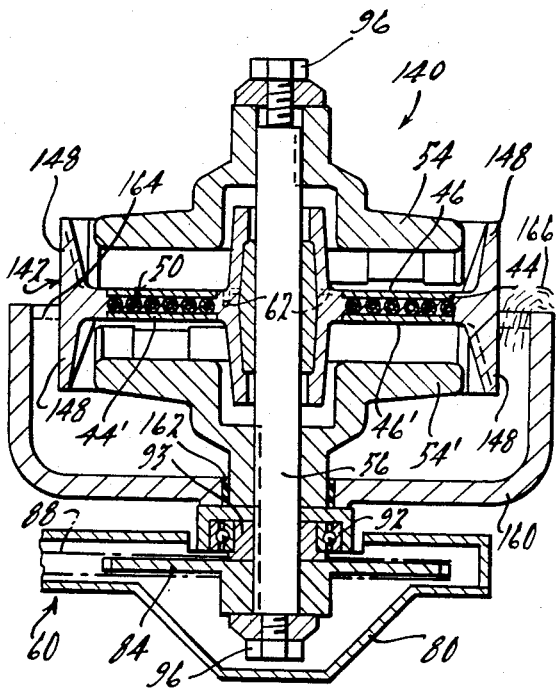
FIG. 10.

FIG. 6.
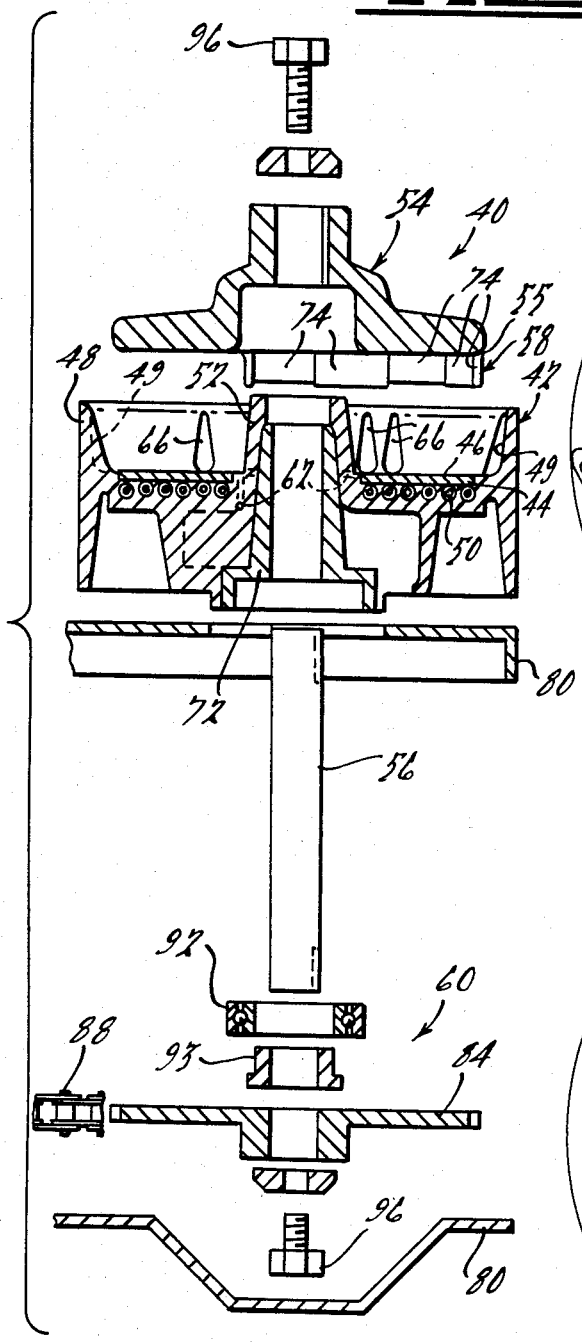
FIG. 7.
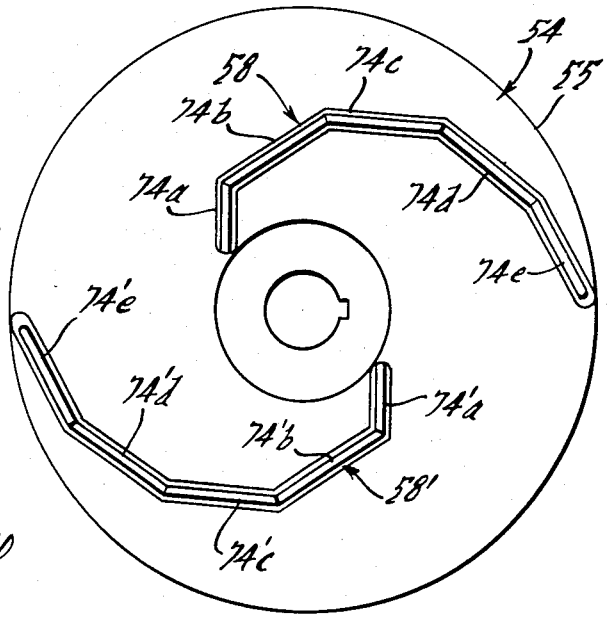
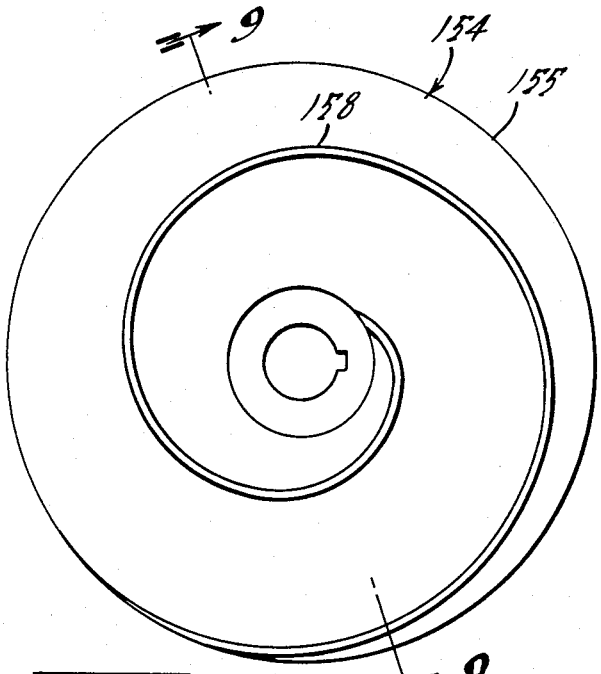
FIG. 8.
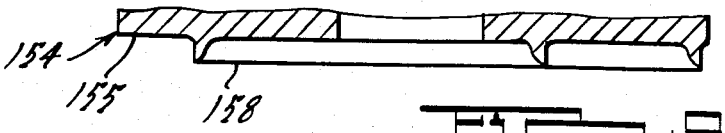
FIG. 9.

APPARATUS AND METHOD FOR MAKING ICE PARTICLES AND METHOD OF MAKING SAID APPARATUS

BACKGROUND AND SUMMARY OF THE INVENTION

Generally, the present invention is directed toward a new and improved apparatus and method for making an ice product of the so-called "flake" or "chip" type commonly used for cooling beverages and the like, and toward a new and improved method of making such an apparatus. More specifically, the present invention is directed toward an apparatus and method for making an ice product of the above-mentioned type having improved ice quality, storage, appearance, and dispensing and displacement characteristics, as compared to various types or prior art flake-type or chip-type ice products. Additionally, the present invention is directed toward and ice making machine or system for producing such high-quality ice products, which incorporates a new and improved combination evaporator and ice-forming assembly, and toward a method of making such assembly.

Prior ice making machines for producing flake or chip ice have typically included vertically-extending rotatable augers that scrape ice crystals from tubular freezing cylinders disposed about the periphery of the augers. The augers in such prior devices typically urge the scraped ice in the form of a slush through open ends of the freezing cylinders, or perhaps through a die or the like in order to form the flake or chip ice product. Other ice making devices include freezing cylinders and moveable external blades for scraping ice crystals from the outside surface of the freezing cylinders. One example of an ice making machine employing one of the above-described vertical freezer cylinders is disclosed in U.S. Pat. No. 3,921,415. Such ice making machines of the type employing vertical freezing cylinders have frequently been overly complex and expensive to manufacture and maintain, and have also typically been quite large and bulky, therefore taking up a great amount of space in their ultimate installations. In addition, such prior ice making machines have frequently been uable to produce a high quality flake or chip ice product having a low percentage of unfrozen water interspersed between the ice particles.

Prior departures from the above-described vertical cylinder-type ice making machines have employed a generally horizontally-extending freezer surface with a rotatable element for scraping ice from the freezer surface. Examples of such prior horizontal-type ice making machines are disclosed in U.S. Pat. No. Re. 28,924 and in German Utility Model No. PA769,337. Such prior horizontal-type ice making machines, however, have not fully overcome the above-discussed disadvantages of the vertical cylinder ice making machines. The need has therefore arisen for an apparatus and method for making chip or flake ice that is compact in size, inexpensive to manufacture and operate, and capable of producing a high-quality ice product.

An ice making apparatus according to the present invention includes a refrigeration system and a combination evaporator and ice-forming assembly preferably comprising a generally horizontal freezer plate with a freezer surface thereon adapted for receiving ice make-up water deposited thereon, evaporator means for cooling the freezer surface in order to form a thin layer of substantially hard-frozen ice thereon, and a rotatable ice breaker disposed adjacent the freezer surface with blade means thereon. Preferably, at least the freezer plate and the evaporator means are integrally encased and molded in a monolithic freezer member composed of a molded polymeric material, with the freezer surface exposed for forming the ice layer thereon. The ice breaker is also preferably fabricated of a cast material, or more preferably a molded polymeric material, and therefore requires little or no matching during its formation and fabrication.

An edge portion of the blade means is located in close proximity with the freezer surface for forcibly fracturing the substantially hard-frozen ice layer into formed ice particles as the ice breaker is rotated. The preferred blade-like member extends along a generally spiral-shaped path from a radially inward portion of the ice breaker to a radially peripheral portion thereof and urges the fractured ice particles in a radially outward direction to be discharged from between the ice breaker and the freezer surface. The peripheral portion of the ice breaker is preferably disposed closely adjacent to, but radially spaced from, an upstanding peripheral skirt portion of the freezer member in order to compress quantities of the ice particles therebetween as they are discharged, thereby compressingly removing unfrozen water therefrom. The high quality ice particles are then preferably deposited into an enclosure or other receptacle for storage and dispensing.

Because the ice breaker fractures the brittle, substantially hard-frozen ice layer on the freezer surface into formed, substantially hard-frozen ice particles, the ice making apparatus according to the present invention generally requires less driving torque to rotate its ice breaker than those of the prior art and therefore requires less energy to operate.

It is accordingly a general object of the present invention to provide a new and improved ice making machine or system.

Another object of the present invention is to provide a new and improved method of making the above-mentioned ice making machine.

Still another object of the present invention is to provide a new and improved method of making flake-type or chip-type ice products.

A further object of the present invention is to provide a new and improved ice making machine that has fewer moving parts than comparable prior ice making machines, that will be more dependable in operation, inexpensive to manufacture and maintain, that requires a minimum amount of machining operations, and that can be easily serviced.

Still another object of the present invention is to provide a new and improved ice making machine having reduced energy requirements by way of a new method of fabricating the combination evaporator and ice forming assembly wherein portions of the assembly are formed by injection molding, for example, from a moldable polymeric material such as plastic, and because the ice is fractured in a brittle hard-frozen state rather than being shaved in a less fully frozen state as in the prior art.

Still another object of the present invention is to provide a uniform distribution of water on the ice-forming or freezer surface of an ice making machine according to the invention.

Additional objects, advantages and features of the present invention will become apparent from the following description and appended claims, taken in conjunction with the accompanying drawings.

BRIEF DESCRIPTION OF THE DRAWINGS

FIG. 4 is a cross-sectional view taken along line 4—4 of FIG. 3, with portions removed to illustrate the combination evaporator and ice-forming assembly of the ice making machine of FIG. 1.

FIG. 5 is a top view of a preferred evaporator coil for the combination evaporator and ice-forming assembly shown in FIG. 4.

FIG. 6 is an exploded cross-sectional assembly view of a preferred combination evaporator and ice-forming assembly according to the present invention.

FIG. 7 is a bottom view of a preferred ice breaker of the combination evaporator and ice-forming assembly of FIG. 6.

FIG. 8 is a bottom view of an alternate ice breaker for the combination evaporator and ice-forming assembly of FIG. 6.

FIG. 9 is a fragmentary cross-sectional view taken along line 9—9 of FIG. 8.

FIG. 10 is an alternate combination evaporator and ice forming assembly according to the present invention, having a pair of ice breakers incorporated therein.

DETAILED DESCRIPTION OF THE PREFERRED EMBODIMENTS

FIGS. 1 through 10 depict exemplary preferred embodiments of the present invention, for purposes of illustration, as incorporated into a self-contained ice making machine. One skilled in the art will readily recognize that the principles of the present invention are equally applicable to other types of ice making apparatus as well as to other types of refrigeration apparatus.

Figure 1:
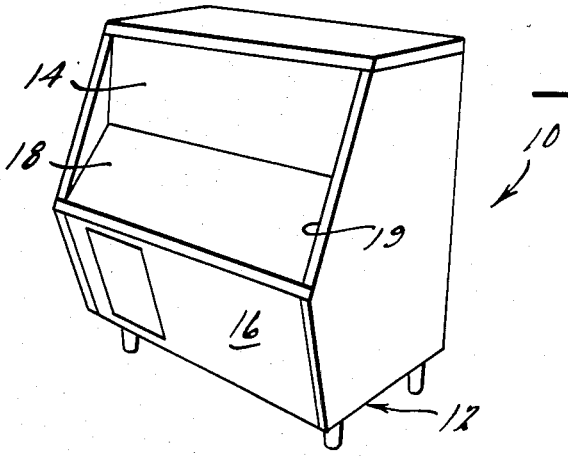
FIG. 1 is an elevated perspective view of an ice making machine incorporating the principles of the present invention.
Figure 2:
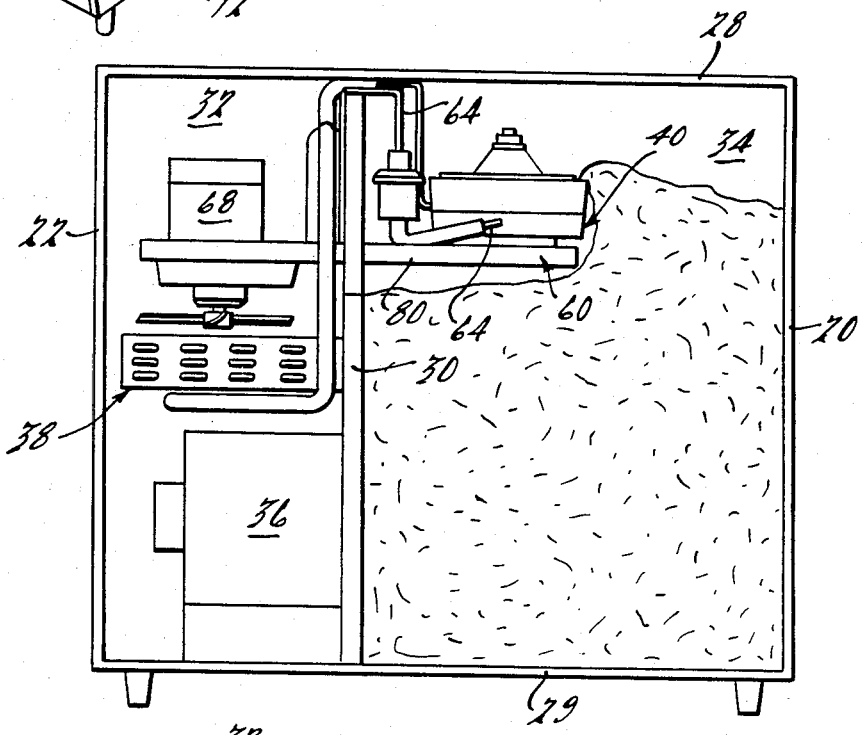
FIG. 2 is a front elevational view of the ice making machine of FIG. 1, with a front portion of its outer enclosure removed to illustrate generally the components thereof.
Figure 3:
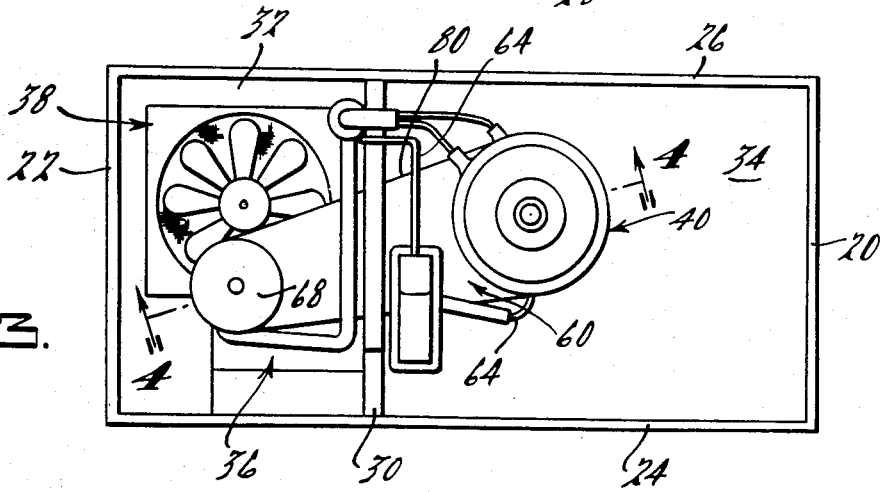
FIG. 3 is a top view of the ice making machine of FIG. 1, with a top portion of its outer enclosure removed in order to illustrate generally the components thereof.

As shown in FIG. 1, an ice making machine 10, in accordance with one preferred embodiment of the present invention, generally includes an enclosure or cabinet 12 having an upper ice making section 14 and a lower receiving and/or storage section 16 provided with a suitable access door or panel 18 in an ice dispensing opening 19. As shown in FIGS. 2 and 3, the cabinet 12 preferably includes a pair of laterally-spaced, generally vertically-extending, end wall sections 20 and 22, as well as front and rear wall sections 24 and 26, respectively, extending in a generally lateral direction between the end wall sections 20 and 22. The cabinet enclosure is completed by upper section 28 and bottom section 29. As is best shown in FIGS. 2 and 3, the enclosure or cabinet 12 includes a supporting partition or wall 30 disposed in the interior of the cabinet between the front and rear wall sections, respectively, for dividing the interior of the cabinet 12 into a refrigeration area 32 and an ice making area 34.

As is conventional in the art, the refrigeration area 32 is provided with a suitable refrigeration compressor 26 and a condenser 38, which cooperate in the ice making area 34 with a combination evaporator and ice-forming assembly 40 (described more fully below), all of which are connected through conventional refrigeration lines (not shown), and function in the usual manner such that gaseous refrigerant at relatively high pressure is supplied by the compressor 36 to the condenser 38. The gaseous refrigerant is cooled and liquified as it passes through the condenser 38 and flows to the evaporator and ice forming assembly 40 wherein the refrigerant is evaporated or vaporized by the transfer of heat thereto from water which is being formed into ice. The gaseous refrigerant then flows from the evaporator and ice-forming assembly 40 back to the inlet or suction side of the compressor 36 for recycling.

It will be understood, of course, by one skilled in the art that the present invention is not intended to be limited to the specific construction of the cabinet or enclosure 12 of the ice making machine 10, since the principles of the present invention can be employed in various types of enclosures and may be incorporated with various types of refrigeration systems that do not necessarily require that their structural components by operatively disclosed within an enclosure. Additionally, the preferred structural relationship of the ice making section 14 disposed above the ice storage section 16, as shown in FIG. 1, is in no way intended to be limiting to the principles of the present invention since the ice storage area associated with the ice making apparatus disclosed herein may alternately be located above, adjacent, or remote from the remainder of the ice making apparatus without departing from the spirit and scope of the present invention.

As shown in FIGS. 4 through 7, a preferred combination evaporator and ice-forming assembly 40 generally includes a freezer member 42 and an ice breaker 54 mounted on a shaft 56 in a position generally adjacent the freezer member 42 for rotation relative thereto. The freezer member 42 preferably includes a freezer plate 44 having a freezer surface 46 on the one side thereof, a skirt portion 49 circumferentially disposed about the periphery of the freezer member 42 and protruding in a generally upward axial direction, and an evaporator coil 50. The ice breaker 54 includes one or more blade-like members 58 and 58' (see FIG. 7, for example) extending along a generally spiral-shaped path from a radially inward portion of the ice breaker 54 to its peripheral portion 55. If more than one blade-like member 58, 58' is used, adjacent blade-like members are preferably widely-spaced, the circumferentially spacing between corresponding radial positions preferably being substantially wider than the circumferential width of the blade-like members themselves.

The freezer plate 44 which is annular in shape in the preferred embodiment, surrounds a central portion 52 of the freezer member and extends radially from the central portion 52 to the skirt portion 48. A make-up water passage 62 (described in more detail below) extends through the freezer member 52 to communicate an external source of make-up water from a make-up water conveying system 64 (see FIGS. 2 and 3) to the freezer surface 46. The evaporator coil 50, which is in close physical proximity or actual physical contact with the freezer plate 44, cools the make-up water on the freezer surface 46 to cause a thin layer of ice to form on the freezer surface. The ice breaker 54 is rotated by the shaft 56 protruding through a sleeve member 72 on the freezer member 42, and the shaft 56 is in turn rotated by a drive train system 60 (described more fully below). As the ice breaker 54 rotates, the blade-like members 58 forcibly fracture the thin layer of ice formed on the freezer surface 46 into small formed ice particles and forcibly urge the formed ice particles in a generally radial outward direction to the peripheral portion 55.

As the fractured ice particles are discharged from between the freezer surface 46 and the peripheral portion 55 of the ice breaker 54, the blade-like members 58, 58' forcibly urge the ice particles through a constricted compression space 70 between the peripheral portion 55 and the skirt portion 48 at the periphery of the freezer member 42. Such compression of quantities of the formed and fractured ice particles causes any unfrozen water disposed or interposed between the ice particles to be compressively removed therefrom. Because the preferred skirt portion 48 of the freezer member 42 protrudes generally in an upward axial direction, and has an interior surface 49 that may be sloped in a slightly radially inward direction toward the freezer plate 44, the compressively removed unfrozen water is separated from the ice particles and caused to flow back onto the freezer surface 46 so as to be subjected to the reduced temperature conditions thereof for future freezing. The interior surface 49 of the skirt portion 48 also preferably includes a plurality of circumferentially-spaced and radially inwardly projecting ribs 66 thereon which engage the ice particles as they are discharged from between the freezer surface 46 and the ice breaker 54 in order to prevent the formed mass of ice particles from rotating along with the ice breaker 54, which ribs 66 thereby direct the ice particles upwardly and outwardly over the outer peripheral edge of the skirt portion 48. Such ribs 66 also displace the ice particles and thereby aid in the compression of the ice particles as described above. The fractured ice particles are preferably permitted to fall by gravity into an area for storage either directly or via some type of conveying device to a remote storage facility. In the illustrated embodiment, the ice particles are intended to fall by gravity into the lower portion of the ice making section 14 for storage and/or subsequent dispensing.

In one form of the ice breaker 54, the blade-like members 58 and 58' are each made up of a plurality of segments 74 disposed generally end-to-end along a generally spiral-shaped path as illustrated in FIGS. 6 and 7. Preferably, the segments 74 of the blade-like members 58 and 58' have heights (or axial dimensions) which alternately increase and decrease along the spiral-shaped path such that the axial spacing between the freezer surface 46 and the edge portion of the blade-like members 58 and 58' also alternately increases and decreases along the spiral-shaped path. Additionally, if the ice breaker 54 includes more than one blade-like member 58, such as is illustrated by numerals 58 and 58' in FIG. 7, for example, the axial dimension or height of any particular segment 74 on one of the blade-like members is greater than its radially-corresponding segment 74 on its adjacent blade-like member. For example, the segments 74*a*, 74*c* and 74*e*, of the blade-like member 58 may have axial heights greater than the intermediate segments 74*b* and 74*d* of the same blade-like member 58. The blade-like member 58' would then have segments 74'*b* and 74'*d* that are greater in axial height than the segments 74'*a*, 74'*c* and 74'*e* of the same blade-like member 58'. As the ice breaker slowly rotates, such alternating axial heights or dimensions of the various segments 74 on the blade-like members 58 and 58', and the opposite alternating pattern on adjacent blade-like members, provide relieved areas in the ice formation on the freezer surface 46. The adjacent portions of the fractured ice particles may thus be radially and outwardly urged into such relieved areas in the ice formation, thereby facilitating the radially outward flow of the fractured ice particles and requiring less energy to rotate the ice breaker. It should be noted that such alternatingly increasing and decreasing axial heights of the blade-like member (or members) of any particular ice breaker version according to the present invention may be employed regardless of the material of which the ice breaker is composed, regardless of the number of blade-like members, and regardless of whether such blade-like member or members are made up of a plurality of segments or are formed in a continuously curving spiral-like configuration such as that shown in FIG. 8 discussed below.

Although the ice breaker 54 may be composed of a cast metallic material, it is preferred that the ice breaker 54 is formed as a monolithic one-piece structure from a suitable polymeric material, such as plastic, having the required moldable and sanitary characteristics, as well as having the requisite strength and integrity to fracture the hard layer of formed ice on the freezer surface 46 into small formed ice particles as the ice breaker is rotated.

The ice breaker 54 and the shaft 56 are operatively connected by way of the drive train system 60 with an electric motor 68 (or other prime mover) that is located external to the ice making area 34 as shown in FIGS. 2 and 3. The drive train system 60 generally includes a generally hollow housing 80 sealingly laterally through an opening 82 in the partition 30, a driven sprocket 84, a driving sprocket 826, a drive chain 88, and an external gear or sprocket system 90, all of which are operatively interconnected in a conventional manner to transmit rotational movement from the motor or prime mover 68 to the shaft 56 which is keyed or otherwise fixed to the rotatably driven ice breaker 54. The shaft 56 extends vertically through, and is rotatably supported by, the sleeve member 72 of the freezer member 42, the bearing 92 and the sleeve 94, and is attached to the driven sprocket 84 and to the ice breaker 54 by threaded fasteners 96 or by other suitable means known to those skilled in the art. Preferably the housing 80, which is sealed to the partition 30, also sealingly isolates its interior from the ice making area 34 such that heat generated in the refrigeration area 32 is substantially isolated and insulated from the ice making area 34.

Preferably, the freezer member 42 of the combination evaporator and ice-forming assembly 40 is constructed by integrally molding or encasing the freezer plate 44, the evaporator coil 50, and the sleeve member 72 in a polymeric material, such as polyethylene, polypropylene, or other appropriate material having the required moldable and sanitary characteristics. In such a molding process, which may be carried out by injection molding, for example, the freezer plate, the evaporator coil, and the sleeve member are inserted into the mold prior to the introduction of the polymeric material thereto. In such a process, the freezer plate 44 is positioned in the mold such that the freezer surface 46 will be exposed as an outer surface in the finished freezer member 42. The evaporator coil 50 is positioned at least in close physical proximity, or preferably in physical contact, with the opposite surface of the freezer plate 44 and integrally encased and surrounded within the polymeric material. Because the freezer plate is preferably formed of brass, or other suitable metallic material having a high thermal conductivity, and the polymeric material preferably has a low thermal conductivity relative to that of the freezer plate 44, the evaporator coil 50 thereby efficiently concentrates its cooling heat removal on the freezer plate 44 in order to efficiently form a layer of ice thereon.

In addition to integrally molding or encasing the freezer plate 44, the evaporator coil 50, and the sleeve member 72 in the polymeric material of the freezer member 42, the make-up water passage 62 may also be formed therein during the molding process. Such water passage 62 may be molded into the freezer member 42 by means of one or more removable die portions, or the water passage 62 may be formed by inserting a piece of tubing or conduit into the mold before introducing the polymeric material, thereby integrally molding and encasing the tubing or conduit therein. Alternatively, the freezer member 42 may be molded without the make-up water passage 62, which may be later formed by drilling or other suitable means known to those skilled in the art. It is preferred that at least a portion of the make-up water passage is located in close proximity with a portion of the evaporator coil 50 so that the make-up water is pre-cooled prior to being introduced onto the freezer surface.

It is also preferred that the water passage 62 includes a plurality of circumferentially-spaced outlets in a manifold-like configuration from which the water is distributed evenly onto a plurality of circumferentially-spaced locations on the freezer surface 46. Such an even distribution of water results in a generally even thickness or build-up of ice forming on the freezer surface 46. The generally even or uniform thickness of ice substantially avoids, or at least minimizes, the formation of hard and soft areas of ice on the freezer surface, thereby contributing to the ease of ice-removal and thus the reduction in torque and power requirements for driving the ice breaker.

FIGS. 8 and 9 illustrate an alternate optional ice breaker 154, including a peripheral portion 155 and one or more blade-like members 158. The alternate optional ice breaker 164 is similar to the ice breaker 54 discussed above, except that the blade-like member or members 158 are formed in a continuously curving spiral-shaped configuration rather than being made up of segments arranged in a spiral-shaped path. The variations and features discussed above in connection with the ice breaker 54, such as the alternatingly increasing and decreasing axial heights or dimensions of the blade-like member or members, for example, may also be incorporated into the alternate optional ice breaker 154 shown in FIGS. 8 and 9.

In accordance with the principles of the present invention, the ice breaker 54 is rotated very slowly, generally within the range of approximately 1 r.p.m. to 10 r.p.m., in order to allow sufficient time for the thin layer of ice to freeze on the freezer surface 46 to a substantially fully frozen and hard state. Therefore, as the ice breaker 54 (or 154) rotates, the blade-like member (or members) fractures the thin layer of ice on the freezer surface 46, such that the ice layer is broken into substantially hard-frozen, high-quality, formed ice particles.

Actual prototype ice making machines constructed in accordance with the present invention have been able to achieve ice particles in excess of 80% quality (i.e. 80% fully frozen ice in a given quantity of said ice particles). Such high quality ice particles are believed to be attainable because the ice breaker of the combination evaporator and ice forming assembly, in accordance with the present invention, fractures hard-frozen ice into substantially fully frozen formed ice particles, rather than scraping or shaving ice in a slush form from a freezer surface. Suitable control means may also be incorporated into either the electrical controls for the motor or other prime movers 68, or mechanical means such as a ratchet-pawl or crankshaft and slider mechanism may be incorporated into the drive train system 60, in order to cause the ice breaker 54 to index or rotate intermittently, in partial rotations, at periodic predetermined time intervals. Such indexing or intermittent partial rotation of the ice breaker allows ice to form on the freezing surface of the freezer plate both during and between such partial intermittent rotations, thereby allowing the ice to become substantially fully frozen before being fractured and removed from the freezer plate.

Finally, an alternate combination evaporator and ice-forming assembly 140, as shown in FIG. 10, may also be employed in accordance with the principles of the present invention. The assembly 140 preferably includes a pair of generally horizontal freezer plates 44 and 44' disposed both above and below the evaporator coil 50, and which encased and integrally molded within the polymeric material of the alternate freezer member 142 having dual skirt portions 148. In such alternate version of the present invention, a pair of ice breakers 54 and 54' (or 154 and 154'), for example, are disposed with the edge portions of their blade-like members closely adjacent to, but axially spaced from, the freezer surfaces 46 and 46' of the respective freezer plates 44 and 44'. Both of such ice breakers are preferably keyed or otherwise fixed to a common shaft 56 for rotation therewith.

Additionally, in the alternate embodiment shown in FIG. 10, water is supplied to the lower freezer plate 44' onto its freezer surface 46' preferably by a fixed pan or shroud 160 that generally surrounds the assembly 140 and is continuously supplied water up to a level 164 generally even with, or slightly above, the freezer surface 46' and in contact therewith. As the water in contact with, and adjacent to, the freezer surface 46' freezes, the ice is removed by the ice breaker 54', and is discharged from the assembly 140, the ice particles 166 float to the surface 164 of the water and are then discharged into the ice storage area on the ice-making machine cabinet or enclosure. The shroud or pan 160 is preferably fixedly mounted, such as to the fixed outer portion of the bearing assembly 92, and is equipped with a sealing member 162 to prevent water leakage into the cabinet or enclosure. The upper freezer surface 46 is preferably supplied with water through the water passage or passage 62 as described above. In virtually all other respects, the components, features, and functions of the alternate combination evaporator and ice-forming assembly 140 are similar to those described above for the corresponding components of the combination evaporator and ice-forming assembly 40 depicted in FIGS. 1 through 9.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. An ice making apparatus comprising:

a refrigeration system including a combination evaporator and ice-forming assembly; and means communicating a source of ice make-up water to said assembly;

said assembly including a generally horizontal freezer plate, conveying means for conveying said make-up water onto a generally horizontal freezing surface on one side of said freezer plate, said conveying means including manifold means having a plurality of circumferentially-spaced outlets for distributing said make-up water onto a plurality of locations on said freezer surface, evaporator means disposed on the opposite side of said freezer plate from said freezing surface, a rotatable ice breaker disposed generally adjacent said freezer surface for rotation about an axis generally perpendicular to said horizontal freezing surface, said ice breaker being generally disc-shaped and having at least one blade-like member on a face thereof that is oriented toward said freezer plate, said blade-like member extending generally horizontally along a generally spiral-shaped path from a radially inward position on said ice breaker to a radially peripheral position thereon, an edge portion of said blade-like member being located in close proximity with said freezer surface but axially spaced therefrom in order to forcibly fracture ice thereon into formed ice prticles, said fractured ice particles being forcibly urged in a generally radial outward direction by said blade-like member and further being discharged from between said freezer surface and said ice breaker as said ice breaker is rotated, and compression means fixed relative to said freezer plate generally at said radially peripheral position thereon for compressing quantities of said fractured ice particles as said ice particles are discharged from between said freezer surface and said ice breaker in order to remove unfrozen water from said ice particles.

2. An ice making apparatus comprising:

a refrigeration system including a combination evaporator and ice-forming assembly; and means communicating a source of ice make-up water to said assembly;

said assembly including a freezer plate, means for conveying said make-up water onto a freezing surface on one side of said freezer plate, evaporator means disposed on the opposite side of said freezer plate from said freezing surface, an ice breaker disposed generally adjacent said freezer surface for rotation about an axis, said ice breaker having at least one blade-like member extending along a generally sprial-shaped path from a radially inward position on said ice breaker to a radially peripheral position thereon, an edge portion of said blade-like member being located in close proximity with said freezer surface but axially spaced therefrom in order to forcibly fracture ice thereon into formed ice particles, said fractured ice particles being forcibly urged in a generally radial outward direction by said blade-like member and further being discharged from between said freezer surface and said ice breaker as said ice breaker is rotated, compression means fixed relative to said freezer plate for compressing quantities of said fractured ice particles as said ice particles are discharged from between said freezer surface and said ice breaker in order to remove unfrozen water from said ice particles, and means for urging said fractured ice particles in a generally upward and radially outward direction and for causing said unfrozen water to flow back onto said freezer plate as it is compressively removed from said ice particles.

3. An ice making apparatus comprising:

a refrigeration system including a combination evaporator and ice-forming assembly;

means communicating a source of ice make-up water to said assembly;

said assembly including a freezer plate, means for conveying and make-up water onto a freezing surface on one side of said freezer plate, evaporator means disposed on the opposite side of said freezer plate from said freezing surface, an ice breaker disposed generally adjacent said freezer surface for rotation about an axis, said ice breaker having at least one blade-like member extending along a generally spiral-shaped path from a radially inward position on said ice breaker to a radially peripheral position thereon, an edge portion of said blade-like member being located in close proximity with said freezer surface but axially spaced therefrom in order to forcibly fracture ice thereon into formed ice particles, said fractured ice particles being forcibly urged in a generally radial outward direction by said blade-like member and further being discharged from between said freezer surface and said ice breaker as said ice breaker is rotated, and compression means fixed relative to said freezer plate for compressing quantities of said fractured ice particles as said ice particles are discharged from between said freezer surface and said ice breaker in order to remove unfrozen water from said ice particles, and control means for intermittently and at least partially rotating said ice breaker at predetermined periodic time intervals in order to allow said ice to form on said freezing surface of said freezer plate between rotations of said ice breaker.

4. In an ice making apparatus having a refrigeration system including a combination evaporator and ice-forming assembly and means for conveying ice make-up water to said assembly, the improvement wherein said assembly comprises a freezer member, a generally horizontal freezer plate on said freezer member with a generally horizontal freezer surface on one side of said freezer plate, said generally horizontal freezer surface being adapted for receiving said make-up water deposited thereon from said conveying means, evaporator means for cooling said freezer surface in order to form ice thereon, said evaporator means being disposed on the opposite side of said freezer plate at least in close physical proximity therewith, said freezer member being composed of a molded polymeric material, said freezer plate and said evaporator means being integrally molded in said freezer member with said freezer surface being exposed for forming said ice thereon, and an ice breaker disposed generally adjacent said freezer surface for rotation relative to said freezer surface about an axis, said ice breaker including blade means located in close proxmity with said freezer surface for forcibly fracturing ice formed thereon into formed particles as said ice breaker is rotated, said ice breaker being a one-piece monolithic structure composed of a polymeric material, said freezer member including a make-up water passage extending therethrough in fluid communication both with said ice make-up water conveying means and with said freezer surface for conveying said make-up water from said conveying means to said freezer surface.

5. The improvement according to claim 4, wherein said make-up water passage includes mainfold means having a plurality of circumferentially-spaced outlets for distributing said make-up water onto a plurality of locations on said freezer surface.

6. The improvement according to claim 4, wherein said evaporator means is disposed between said freezer plate and said make-up water passage, said evaporator means being in close physical proximity with said make-up water passage in order to pre-cool said make-up water before said make-up water is introduced onto said freezer surface.

7. In an ice making apparatus having a refrigeration system including a combination evaporator and ice-forming assembly and means for conveying ice make-up water to said assembly, the improvement wherein said assembly comprises a freezer member, a generally horizontal freezer plate on said freezer member with a generally horizontal freezer surface on one side of said freezer plate, said generally horizontal freezer surface being adapted for receiving said make-up water deposited thereon from said conveying means, evaporator means for cooling said freezer surface in order to form ice thereon, said evaporator means being disposed on the opposite side of said freezer plate at least in close physical proximity therewith, said freezer member being composed of a molded polymeric material, said freezer plate and said evaporator means being integrally molded in said freezer member with said freezer surface being exposed for forming said ice therein, and an ice breaker disposed generally adjacent said freezer surface for rotation relative to said freezer surface about an axis, said ice breaker including blade means located in close proximity with said freezer surface for forcibly fracturing ice formed thereon into formed particles as said ice breaker is rotated, said ice breaker being a one-piece monolithic structure composed of a polymeric material, said freezer member further including an integrally molded skirt portion circumferentially disposed about the periphery of said freezer member, said skirt portion further extending generally in an axial direction away from said freezer plate and away from said evaporator means and being radially spaced from the radial periphery of said ice breaker, quantities of said fractured ice particles being compressed between said ice breaker and said skirt portion in order to remove unfrozen water therefrom.

8. The improvement according to claim 7, wherein said blade means on said ice breaker extends along a generally spiral-shaped path from a radially inward portion of said ice breaker to said radial periphery thereof in order to forcibly urge said fractured ice particles in a generally radial outward direction and to discharge said fractured ice particles from between said freezer surface and said ice breaker as said ice breaker is rotated.

9. The improvement according to claim 8, wherein said skirt portion includes a plurality of rib members integrally molded thereon for preventing said discharged ice particle from rotating with said ice breaker.

10. The improvement according to claim 9, wherein said ice breaker is disposed above said generally horizontal freezer plate, said evaporator means being disposed below said generally horizontal freezer plate, and said skirt portion extending in a generally upward axial direction.

11. The improvement according to claim 10, wherein said assembly further includes a second generally horizontal freezer plate disposed below said evaporator means and having a second freezer surface on its lower side adapted for receiving said make-up water deposited thereon from said conveying means, said assembly further including a second ice breaker disposed below and generally adjacent said second freezer surface for rotation relative thereto about said axis, said second ice breaker including second blade means located in close proximity with said second freezer surface for forcibly fracturing ice on said freezer surfaces into formed particles of ice as said ice breaker is rotated.

12. The improvement according to claim 11, wherein said assembly further includes an open-ended shroud member generally adjacent and below said second freezer surface, said shroud member being adapted for containing water therein at a water level in contact with said second freezer surface in order to form ice thereon, said formed ice particles thereby being discharged into said water in said shroud member wherein they are allowed to float to the surface of said water and be discharged from the open-end of said shroud member.

13. An ice making system comprising in combination:

an enclosure having a generally horizontal bottom section, a generally upwardly projecting side wall section extending around the periphery of said bottom section, and an ice dispensing opening formed in said side wall section;

refrigeration apparatus located external to said enclosure, said refrigeration apparatus including condensing means for condensing a flowable refrigerant;

a source of ice make-up water located external to said enclosure;

a prime mover located external to said enclosure;

a combination evaporator and ice-forming assembly located within said enclosure generally at an upper portion of the interior thereof, said assembly including a freezer member, a generally horizontal freezer plate located on said freezer member and having a generally horizontal freezer surface on its upper side, means for conveying said make-up water from said source onto said freezer surface, an evaporator coil disposed on the opposite side of said freezer plate at least in close proximity therewith, means for supplying refrigerant to said evaporator coil from said refrigeration apparatus and for returning evaporated refrigerant thereto, an ice breaker disposed generally above said freezer surface for rotation relative to said freezer surface about a generally vertical axis, drive train means extending through an opening in said side wall section for transmitting rotation to said ice breaker from said prime mover located external to said enclosure, said ice breaker having at least one blade-like member extending along a generally spiral-shaped path from a radially inward portion of said ice breaker to the radial periphery thereof, an edge portion of said blade-like member being located in close proximity with said freezer surface but axially-spaced therefrom, said fractured ice particles being forcibly urged in a generally radially outward direction by said blade-like member and further being discharged from between said freezer surface and said ice breaker as said breaker is rotated, said freezer member further including means located adjacent the periphery of said ice breaker for directing said discharged ice particles into said enclosure, said freezer member being composed of a molded polymeric material, said freezer plate and said evaporator coil being integrally molded in said freezer member with said freezer surface being exposed for forming said ice thereon, said freezer plate being composed of a metallic material having a high thermal conductivity relative to that of said molded polymeric material, said ice breaker being a one-piece monolithic structure composed of a polymeric material, and said freezer member including an integrally-molded skirt portion extending circumferentially about the periphery of said freezer member closely adjacent to but radially spaced from said periphery of said ice breaker for compressing quantities of said discharged ice particles therebetween in order to remove unfrozen water therefrom before said ice particles are directed into said enclosure, said skirt portion protruding in a generally upward axial direction, said skirt portion having a plurality of circumferentially-spaced ribs located on a generally radially inward side of said skirt portion for preventing said discharged ice particles from rotating with said ice breaker.

14. An ice making system according to claim 13, wherein said assembly further includes a second generally horizontal freezer plate disposed below said evaporator coil and having a second generally horizontal freezer surface on its lower side adapted for receiving said make-up water deposited thereon from said conveying means, said assembly further including a second ice breaker disposed below and generally adjacent said second freezer surface for rotation relative thereto about said axis, said second ice breaker also being operatively connected to said drive train means for rotation with said first ice breaker and including second blade means located in close proximity with said second freezer surface for forcibly fracturing ice thereon into formed particles of ice as said ice breaker is rotated.

15. An ice making system according to claim 14, wherein said assembly further includes an open-ended shroud member generally adjacent and below said second freezer surface, said shroud member being adapted for containing water therein at a water level in contact with said second freezer surface in order to form ice thereon, said formed ice particles thereby being discharged into said water in said shroud member wherein they are allowed to float to the surface of said water and be discharged from the open end of said shroud member into said enclosure.

16. An ice making system comprising in combination:

an enclosure having a generally horizontal bottom section, a generally upwardly projecting side wall section extending around the periphery of said bottom section, and an ice dispensing opening formed in said side wall section;

refrigeration apparatus located external to said enclosure, said refrigeration apparatus including condensing means for condensing a flowable refrigerant;

a source of ice make-up water located external to said enclosure;

a prime mover located external to said enclosure;

a combination evaporator and ice-forming assembly located within said enclosure generally at an upper portion of the interior thereof, said assembly including a freezer member, a generally horizontal freezer plate located on said freezer member and having a generally horizontal freezer surface on its upper side, means for conveying said make-up water from said source onto said freezer surface, an evaporator coil disposed on the opposite side of said freezer plate at least in close proximity therewith, means for supplying refrigerant to said evaporator coil from said refrigeration apparatus and for returning evaporated refrigerant thereto, an ice breaker disposed generally above said freezer surface for rotation relative to said freezer surface about a generally vertical axis, drive train means extending through an opening in said side wall section for transmitting rotation to said ice breaker from said prime mover located external to said enclosure, said ice breaker having at least one blade-like member extending along a generally spiral-shaped path from a radially inward portion of said ice breaker to the radial periphery thereof, an edge portion of said blade-like member being located in close proximity with said freezer surface but axially-spaced therefrom, said fractured ice particles being forcibly urged in a generally radially outward direction by said blade-like member and further being discharged from between said freezer surface and said ice breaker as said ice breaker is rotated, said freezer member further including means located adjacent the periphery of said ice breaker for directing said discharged ice particles into said enclosure, said freezer member being composed of a molded polymeric material, said freezer plate and said evaporator coil being integrally molded in said freezer member with said freezer surface being exposed for forming said ice thereon, said freezer plate being composed of a metallic material having a high thermal conductivity relative to that of said molded polymeric material, said ice breaker being a one-piece monolithic structure composed of a polymeric material, said make-up water conveying means including at least one make-up water passage extending through said freezer member, said passage having an outlet positioned for directing said make-up water onto said freezer surface, and means for intermittently at least partially rotating said ice breaker at predetermined periodic time intervals in order to allow said ice to form on said freezing surface of said freezer plate between rotations of said ice breaker.

17. An ice making system according to claim 16, wherein said evaporator coil is disposed between said freezer plate and said make-up passage, said evaporator coil being in close physical proximity with said make-up water passage in order to pre-cool said make-up water before said make-up water is introduced onto said freezer surface.

18. An ice making system according to claim 17, wherein said make-up water passage includes manifold means having a plurality of circumferentially-spaced outlets for distributing said make-up water onto a plurality of locations on said freezer surface.

* * * * *

UNITED STATES PATENT AND TRADEMARK OFFICE

CERTIFICATE OF CORRECTION

PATENT NO. : 4,527,401

DATED : July 9, 1985

INVENTOR(S) : Kenneth L. Nelson

It is certified that error appears in the above-identified patent and that said Letters Patent is hereby corrected as shown below:

Line 10 of abstract; delete "surface" after --hard-frozen--

Col. 1, line 18; "or" should be --of-- (1st occurr.)

Col. 1, line 44; "uable" should be --unable--

Col. 2, line 10; "matching" should be --machining--

Col. 4, line 2; "26" should be --36--

Col. 4, line 25; "by" should be --be--

Col. 4, line 42; delete "the" before --one--

Col. 4, line 43; "49" should be --48--

Col. 4, line 61; "52" should be --42--

Col. 5, line 17; "interposed" should be --interspersed--

Col. 6, line 35; After "sealingly" insert --extending--

Col. 6, line 37; "826" should be --86--

Col. 7, line 46; "164" should be --154--

Col. 8, line 29; After "which" insert --is--

Col. 8, line 51; "on" should be --of--

Col. 9, lines 32-33; "prticles" should be --particles--

UNITED STATES PATENT AND TRADEMARK OFFICE

CERTIFICATE OF CORRECTION

PATENT NO. : 4,527,401

DATED : July 9, 1985

INVENTOR(S) : Kenneth L. Nelson

It is certified that error appears in the above-identified patent and that said Letters Patent is hereby corrected as shown below:

Col. 9, line 58; "sprial" should be --spiral--

Col. 11, line 3; After "member" insert --further--

Col. 11; line 37; "therein" should be --thereon--

Col. 11, line 68; "particle" should be --particles--

Signed and Sealed this

Seventh Day of October, 1986

[SEAL]

*Attest:*

DONALD J. QUIGG

*Attesting Officer*

*Commissioner of Patents and Trademarks*